US007895964B2

(12) United States Patent
Russikoff

(10) Patent No.: US 7,895,964 B2
(45) Date of Patent: Mar. 1, 2011

(54) RETRACTABLE BOAT TOP WITH ARCHED CANOPY

(76) Inventor: Ronald K. Russikoff, Philadelphia, PA (US)

( * ) Notice: Subject to any disclaimer, the term of this patent is extended or adjusted under 35 U.S.C. 154(b) by 0 days.

(21) Appl. No.: 12/286,588

(22) Filed: Oct. 1, 2008

(65) Prior Publication Data

US 2009/0031942 A1 Feb. 5, 2009

Related U.S. Application Data

(63) Continuation-in-part of application No. 11/487,287, filed on Jul. 15, 2006, now Pat. No. 7,571,691.

(51) Int. Cl.
*B63B 17/00* (2006.01)

(52) U.S. Cl. ..... 114/361

(58) Field of Classification Search ..... 114/363, 114/361

See application file for complete search history.

(56) References Cited

U.S. PATENT DOCUMENTS 4,951,594 A * 8/1990 Feikema ..... 114/361
6,079,474 A * 6/2000 Lin ..... 160/370.22
2002/0053313 A1* 5/2002 Murphy et al. ..... 114/361
2007/0057539 A1* 3/2007 Klein et al. ..... 296/216.01

* cited by examiner

*Primary Examiner*—Stephen Avila
(74) *Attorney, Agent, or Firm*—Armand M. Vozzo, Jr.

(57) ABSTRACT

A retractable boat top device is disclosed having an arched canopy assembly operatively deployed in mounted attachment upon a conventional radar arch or like elevated structure on the deck of a boat. The arched canopy assembly includes a stationery roof section formed having a curved planar surface transversely mounted within the radar arch, a pair of telescoping extension arms mounted on opposite sides of the roof section, and an arched roller assembled to hold a flexible canopy material thereon and operatively connected between the outer ends of the extension arms so that the flexible canopy material may be extended and retracted relative to the stationery roof section in an arched configuration substantially in the same plane as the roof section. The arched roller includes a curved roller bar supported coaxially within the bore of a flexible hose member that supports the canopy material in a rolled-up state and further includes torsion spring members mounted along opposite sides of the roller bar to maintain tension upon the canopy material during roll-out and retraction.

17 Claims, 14 Drawing Sheets

RETRACTABLE BOAT TOP WITH ARCHED CANOPY

CROSS-REFERENCE TO RELATED APPLICATION

This application is a continuation-in-part of application Ser. No. 11/487,287 filed Jul. 15, 2006 now U.S. Pat. No. 7,571,691 for Retractable Bimini Top Device.

BACKGROUND OF THE INVENTION

The present invention relates to convertible top covers for boats, commonly called bimini tops, and more particularly to an improved retractable boat top device having an arched canopy assembled for operative attachment to a radar arch or like structure upon the boat deck that is automated in its operation and adapted to maintain an arched configuration during deployment.

In recreational boating, the so-called "bimini top" is a convertible cover erected upon the deck of the boat and made to be deployed at an elevation comfortably above the heads of the passengers. Drawing its name from the Bimini islands in the Bahamas where it was first employed by boaters to provide desired shade from the strong rays of the tropical sun, the standard type of bimini top and those convertible boat covers of the same nature generally comprise a flexible canvas material secured to a foldable support frame that is erected across the deck and pivotally attached thereto. These standard types of foldable bimini tops can be raised when needed or lowered into a substantially flat position upon the deck when not in use or when an overhead obstruction may otherwise require its lowering. Deployment of these foldable bimini tops is often done manually but has been designed to be power driven, such as those described in U.S. Pat. Nos. 6,209,477 to Briedenweg and 6,983,716 to Ankney et al. Regardless of their specific foldable structure or method of operational deployment, the installation and utilization of bimini tops have become increasingly important for the protection of passengers and crew on board boats against excessive sun exposure and the evident risks of skin cancer caused thereby.

Existing framework generally used to construct present bimini top installations includes a system of poles or like rigid members mounted to the port and starboard sides of the boat and made to extend across the deck at a sufficient height level to support the canvas top overhead the occupants. As currently arranged and implemented, these pole systems typically have separate front and rear pole members over which the canvas top is extended and, depending upon the length of the top from fore to aft, one or more additional pole members are needed and disposed between the front and rear poles to firmly support the intermediate section of the top. Although these pole systems may be pivotally mounted to the boat deck so that they can be folded down and lowered out of the way when the bimini top is not needed, the pole members still obstruct a person on board from reaching out over the side of the boat when fishing, docking or mooring the boat and further present an obstacle in boarding and loading equipment onto the deck. While these and other similarly devised implementations of convertible bimini tops have been effective in providing suitable shade protection from the sun when needed, they have not satisfactorily resolved the problems of obstructions and obstacles caused in and around the boat deck by their supporting framework nor have they provided a completely hands free system of operation both in extended deployment and retracted storage of the bimini top.

Furthermore, in implementing a retractable canopy system, particularly one deployed upon a recreational boat, rain water accumulating upon the extended canopy needs to be continually drained off the extended canopy surface, preferably away from the boat deck in a flow direction that will not affect the passengers. Existing prior art retractable canopy systems heretofore adapted to boat operations, while being effective in their deployments, have not satisfactorily addressed this drainage requirement without reducing headroom on board the deck and limiting visibility for driving the boat forward or in reverse during docking.

SUMMARY OF THE INVENTION

Accordingly, it is a general purpose and object of the present invention to provide an improved retractable canopy top for recreational boats that is fully automated and capable of operative attachment to existing overhead structure on the boat without causing obstructions upon the deck.

A more particular object of the present invention is to provide an improved automated retractable canopy top capable of deployment upon the existing radar arch structure of a recreational boat that effectively shades those on board from the sun and drains any accumulating rain water away from the deck of the boat without adversely affecting headroom of the passengers or visibility of the driver.

Another object of the present invention is to provide an automated retractable canopy top for recreational boats that is capable of providing effective sunshade protection to persons on board the boat without presenting obstructions to their movement or performance of tasks on or around the deck.

Still another object of the present invention is to provide an improved automated retractable canopy device that is particularly suitable for use upon a sport fishing boat to provide fishermen with needed shade protection even while game fishing and without hindering their performance.

A further object of the present invention is to provide an automated retractable boat top device that is capable of hands free operation between an extended deployment and retracted state with protection of the retracted top while in storage.

A still further object of the present invention is to provide an automated retractable boat top device that is relatively inexpensive to manufacture, easy to assemble and install upon existing boat structure, and capable of improving the functionality and appearance of the boat upon which it is installed.

Briefly, these and other objects of the present invention are accomplished by an improved retractable boat top device having an arched canopy assembly operatively deployed in mounted attachment upon a conventional radar arch or like elevated structure on the deck of a boat. The arched canopy assembly includes a stationery roof section formed having a curved planar surface transversely mounted within the radar arch, a pair of telescoping extension arms mounted on opposite sides of the roof section, and an arched roller assembled to hold a flexible canopy material thereon and operatively connected between the outer ends of the extension arms so that the flexible canopy material may be extended and retracted relative to the stationery roof section in an arched configuration substantially in the same plane as the roof section. The arched roller includes a curved roller bar supported coaxially within the bore of a flexible hose member that supports the canopy material in a rolled-up state and further includes torsion spring members mounted along opposite sides of the roller bar to maintain tension upon the canopy material during roll-out and retraction.

For a better understanding of these and other aspects of the present invention, reference should be made to the following detailed description taken in conjunction with the accompanying drawings in which like reference numerals and character designate like parts throughout the figures thereof.

BRIEF DESCRIPTION OF THE DRAWINGS

For a fuller understanding of the nature and objects of the present invention, references in the detailed description set forth below shall be made to the accompanying drawings in which.

DETAILED DESCRIPTION OF THE INVENTION

The following is a detailed description of a preferred embodiment of the present invention and the best presently contemplated mode of its production and practice. This description is further made for the purpose of illustrating the general principles of the invention but should not be taken in a limiting sense, the scope of the invention being best determined by reference to the appended claims.

Figure 1:
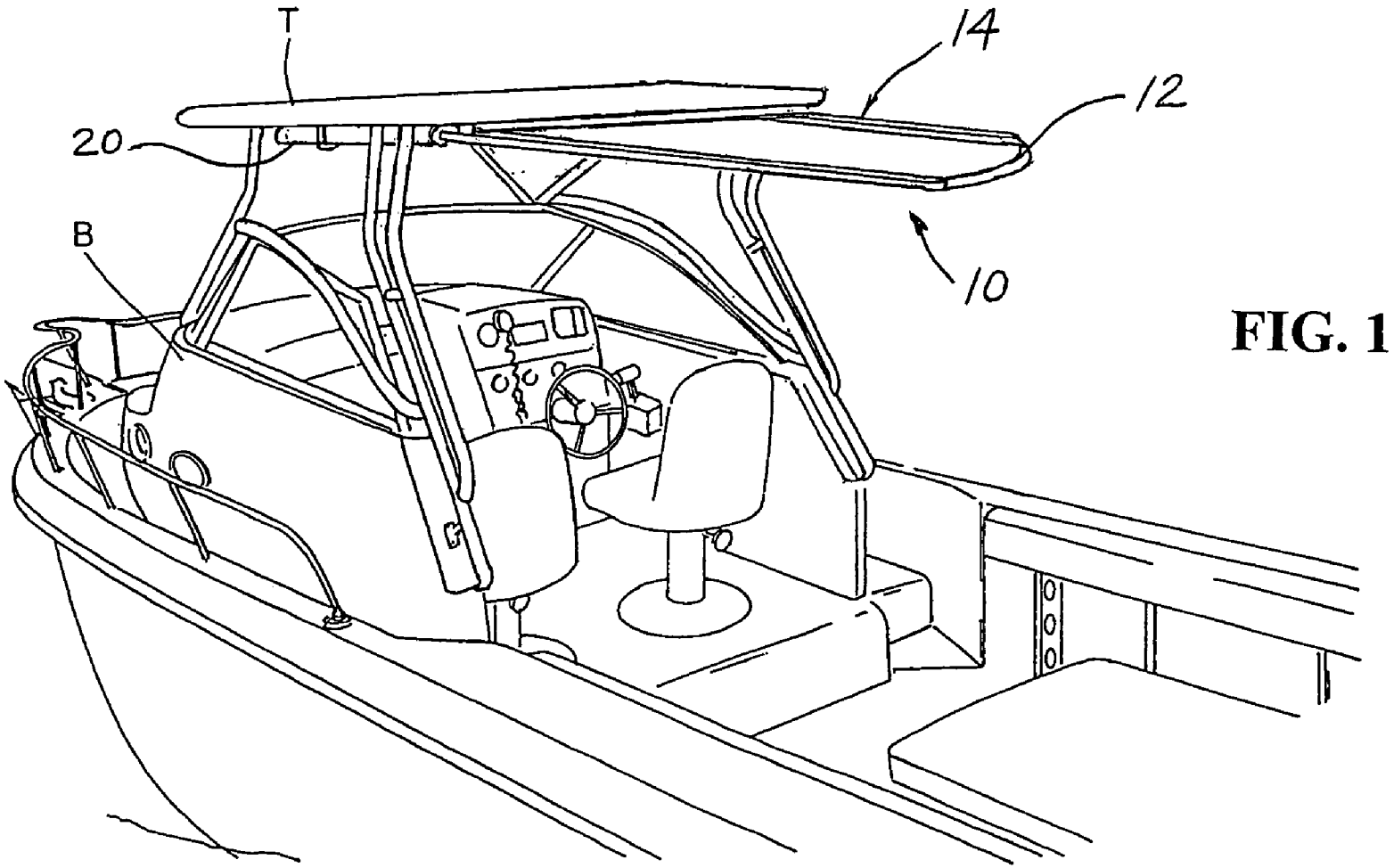
FIG. 1 is a perspective view of a recreational boat equipped with a retractable bimini top device made in accordance with the present invention and shown in extended deployment from rooftop structure on the boat.

Referring now to FIG. 1, a preferred embodiment of the present retractable bimini top device, generally designated 10, is depicted in mounted attachment to and extended deployment from just beneath a rigid canopy or similar rooftop member T set above the deck of a recreational boat B. Designed for automated operation, as described below in greater detail, to provide additional sunshade protection for those on board the boat B, the present retractable bimini top device 10 includes a canvas cover 12 or similar flexible fabric material of an opaque nature that is stored in a rolled-up state and attached at one outer end thereof to a moveable support frame 14 that is disposed for substantially horizontal movement and driven in alternate linear directions through a pair of housing tubes 20 mounted beneath the rooftop member T.

Figure 2:
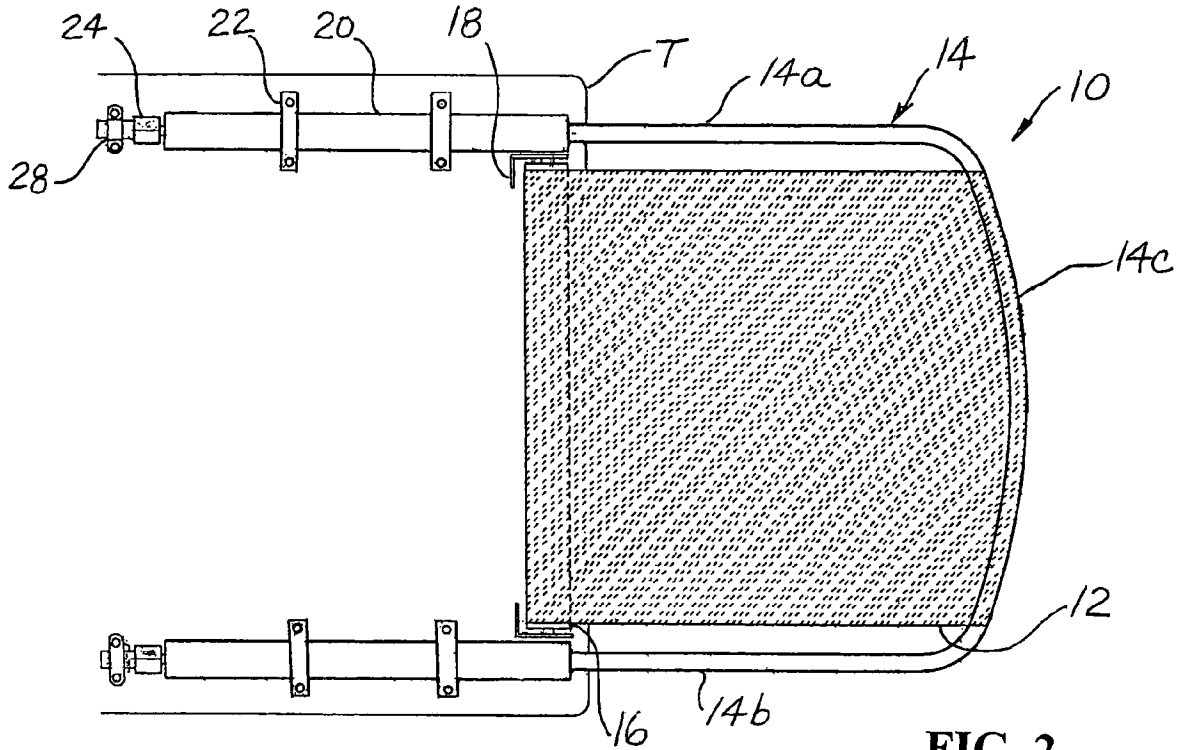
FIG. 2 is a plan view of the retractable bimini top device of FIG. 1 shown in mounted attachment beneath the rooftop structure of the boat.
Figure 3:
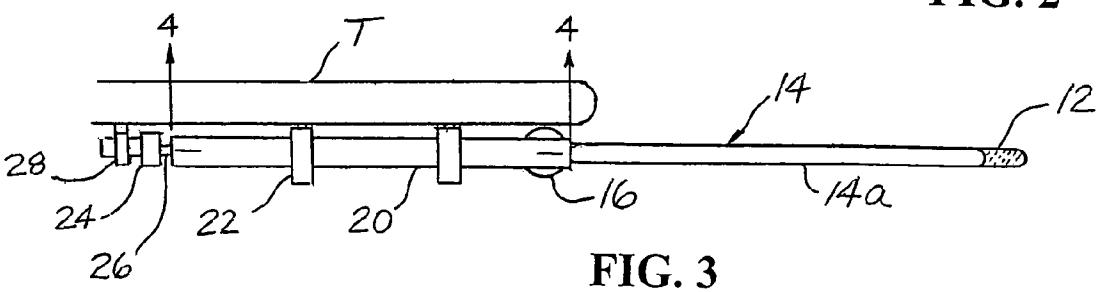
FIG. 3 is a side elevation view of the retractable bimini top device shown in FIG. 2.
Figure 4:
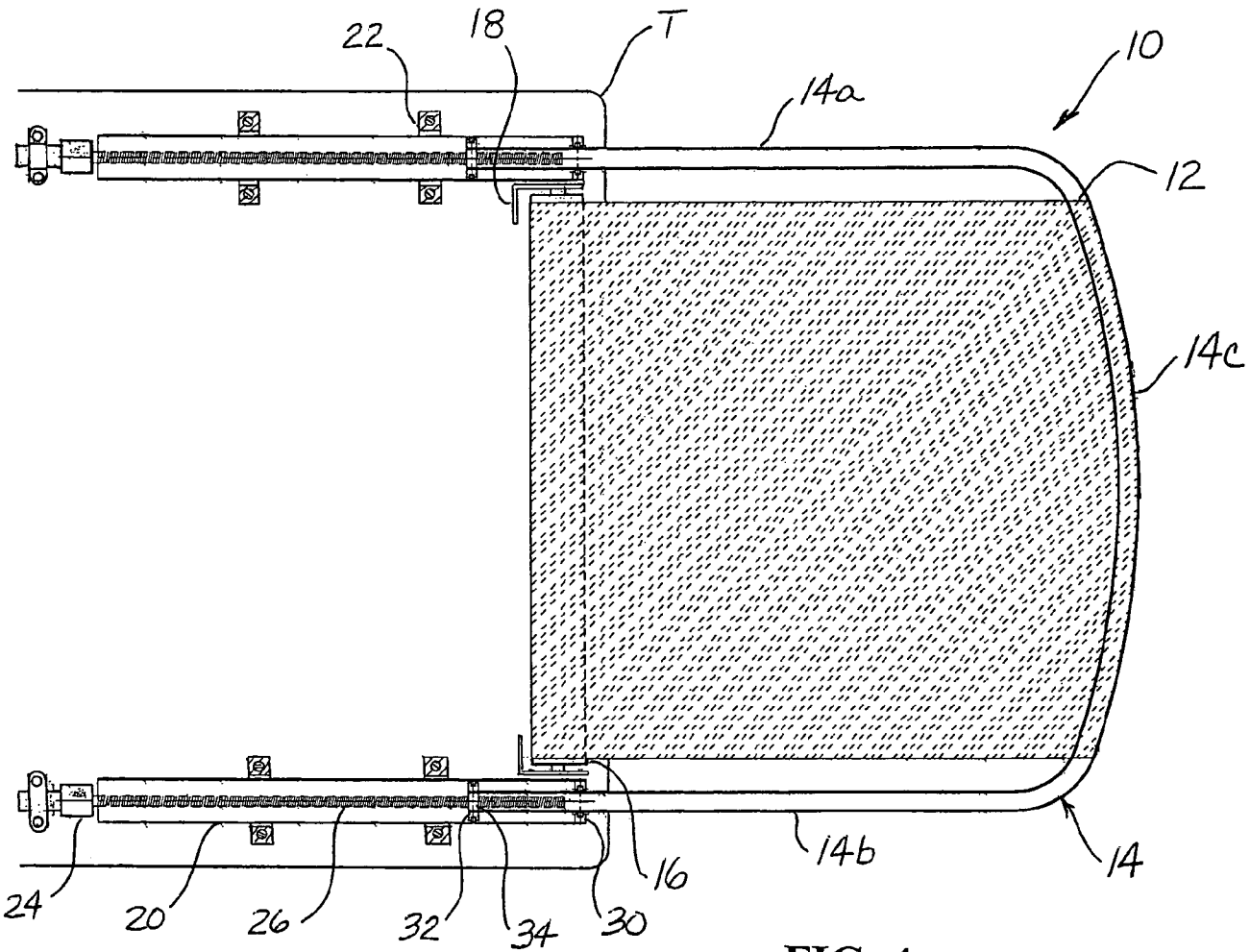
FIG. 4 is an enlarged plan view from below of the retractable bimini top device of FIG. 3 including a partial cross-section taken along the line 4-4 therein.

Referring now to FIGS. 2-4 in conjunction with FIG. 1, the support frame 14 is rigid U-shaped member, preferably tubular in construction, having a pair of substantially parallel legs 14*a* and 14*b* extending longitudinally from a transverse piece 14*c* that is preferably curved in form. The canvas cover 12 is formed and finished in a substantially rectangular configuration, the width thereof being sufficient in size to substantially span the dimension between the legs 14*a* and 14*b* of the support frame. The length of the canvas cover 12 will vary based upon the desired extension of the bimini top device 10. The outer end of the canvas cover 12 is wrapped around the transverse piece 14*c* of the support frame 14 and secured in place, preferably by conventional stitching of the canvas material. The opposite end of the canvas cover 12 is attached along the entire width thereof to the hub interior of a spring-loaded roller 16 of the type commercially available and conventionally used for stored support of retractable awnings. From the interior hub attachment, the canvas cover 12 is wrapped circumferentially in layers around the body of the roller 16 to form the rolled-up state in which the canvas cover is stored in the present bimini top device 10. In its rolled-up state upon spring roller 16, the canvas cover 12 is positioned so as to feed the outer edge of the cover in the direction of the support frame 14 and its attachment to the transverse piece 14*c*, the direction of feed being in opposition to the internal spring force applied and exerted through the spring roller. This internal force is generally established for each spring roller 16 and may be adjusted, typically by turning the roller in place on its end pins. The internal spring force generated by the spring roller 16, adjusted as necessary, assists in the retraction of the canvas cover 12 upon the support frame 14 and further maintains the canvas cover in a relatively taut condition when in extended deployment. A pair of projection brackets 18 of the type conventionally used with standard spring-loaded rollers are positioned to engage opposite ends of spring roller 16 and are attached to the bottom surface of the rooftop member T using conventional hardware to position the roller transversely between the legs 14*a* and 14*b* of the support frame 14 and allow the roller to rotate freely in both directions so that the canvas cover 12 may unroll and retract in a straight path aligned between the opposite legs of the support frame.

The housing tubes 20 used to convey the support frame 14 are cylindrical in form and made in lengths sufficient to contain longitudinally therein substantially all of the respective lengths of the legs 14*a* and 14*b* of the support frame. The housing tubes 20 are spaced apart and disposed in parallel, their separation being established by the transverse dimension between the legs 14*a* and 14*b* of the support frame 14. Positioned in parallel upon the bottom surface of the rooftop T with the spring roller 16 mounted transversely therebetween, the housing tubes 20 are each mounted to the rooftop member via mounting blocks or clamps 22, preferably in pairs along the respective tube lengths, as seen in FIG. 3. Attached to the bottom surface of the rooftop member T using conventional hardware, the mounting blocks 22 are each formed with an aperture therethrough that is made to fit over and engage the outside surface of the housing tubes 20 and together secure the housing tubes in place just beneath the rooftop surface.

A separate pair of reversible electronic motors 24 is used in this preferred embodiment of the present retractable bimini top device 10 to drive the support frame 14 in alternate linear directions through the housing tubes 20 and carrying the attached canvas cover 12. Mounted at the end of each housing tube 20 opposite of the support frame 14, the reversible motors 24 are conventional electronic devices commercially available in a variety of forms and sizes designed to produce a steady level of torque along a drive shaft at predetermined rates of rotation and in opposite directions. In the present embodiment, the drive shaft of each reversible motor 24 is adapted and formed as a lead screw 26, best seen in FIG. 4, having an extended threaded length coaxially disposed through the respective housing tube 20. Each reversible motor 24 is fixed in position at the end of the respective housing tube 20 and mounted to the bottom surface of the rooftop T using a mounting bracket 28 or like form of clamp that holds the body of the motor firmly in place and attaches to the rooftop surface with conventional hardware. The reversible motors 24 are electrically powered and preferably connected to the available power supply on board the boat B with the proper operating voltage being provided using conventional inverters and/or regulators as necessary. Synchronized control of the operation of the reversible motors 24 in both directions is provided by conventional electrical switching, preferably activated by remote-control means, with limit-switching capabilities to limit the revolutions of the lead screw 26 and the corresponding movements of the support frame 14 in both directions.

As best viewed in FIG. 4, the separate legs 14*a* and 14*b* of the support frame 14 each slidingly engage the outer end of the respective housing tube 20 through a bearing fitting 30 affixed to the outer end of each tube. Each end fitting 30 is a ring-like member having a smooth outer surface sized to conform with the inner diameter of the housing tube 20 and an inner bearing surface established by a circular set of ball bearing members, the effective inner diameter of which conforms with the outer surface diameter of the support frame legs 14*a* and 14*b*. Inside each housing tube 20, a moveable bearing fitting 32 is coaxially disposed and further joined and connected to the end of each respective support frame legs 14*a* and 14*b*. Each interior bearing fitting 32 is similarly, like end fittings 30, a ring-like member, but unlike the end fittings, the interior bearing fittings have an outer bearing surface established by a circular set of ball bearing members with the effective outer diameter conforming with the inner surface diameter of the housing tubes 20. The inner surface of each interior bearing fitting 32 is threaded to conform with and engage the threaded surface of each lead screw 26. The inner threading of the interior bearing fittings 32 may be formed integrally upon the surface of the fitting or more preferably, be provided by a threaded insert or nut 34 coaxially fixed therein. As a result of this combination of bearing fittings 30 and 32 and their respective engagements with housing tubes 20 and support frame legs 14*a* and 14*b*, rotational movements of the lead screws 26, concurrently produced under the drive of their respective motor 24, will move the support frame 14 outbound into extended position, as shown particularly in FIG. 4, with the canvas cover 12 fully deployed thereon.

Figure 5:
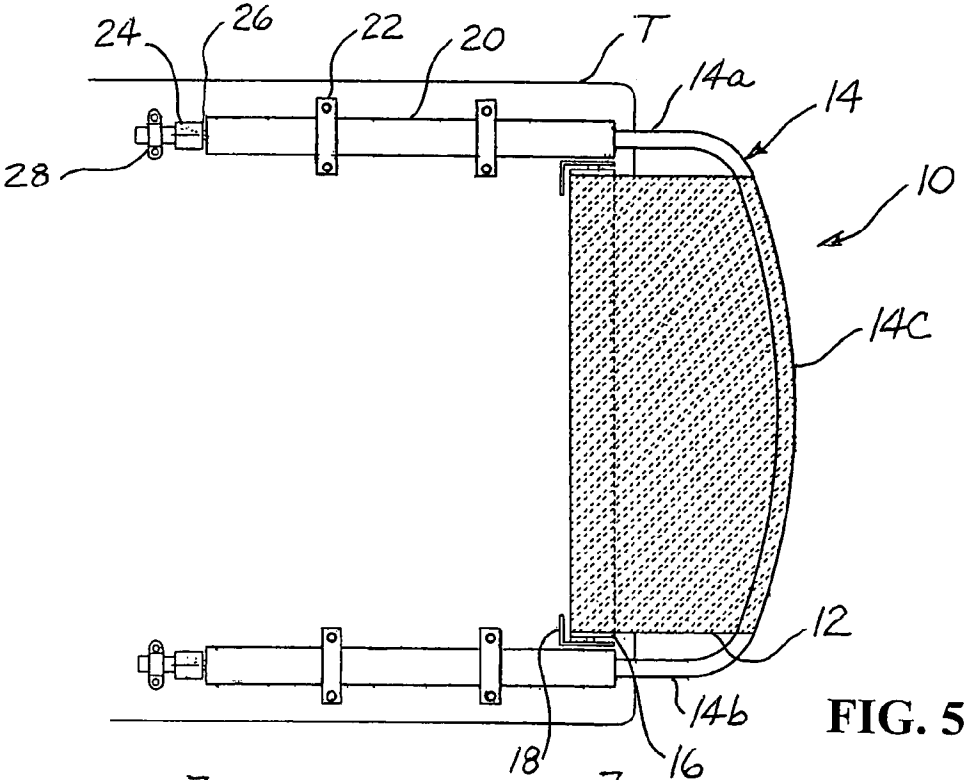
FIG. 5 is a plan view of the retractable bimini top device according to the present invention shown in its retracted position mounted beneath the rooftop structure of the boat.
Figure 6:
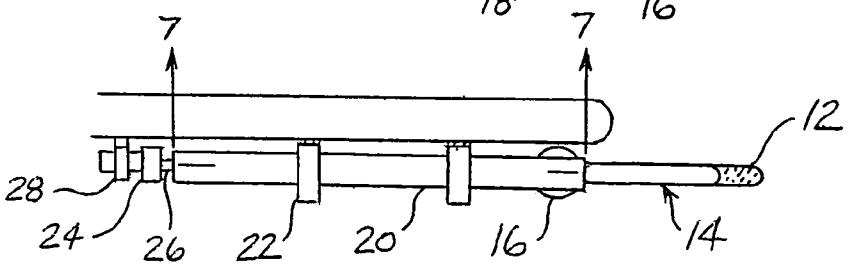
FIG. 6 is a side elevation view of the present retractable bimini top shown in FIG. 5.
Figure 7:
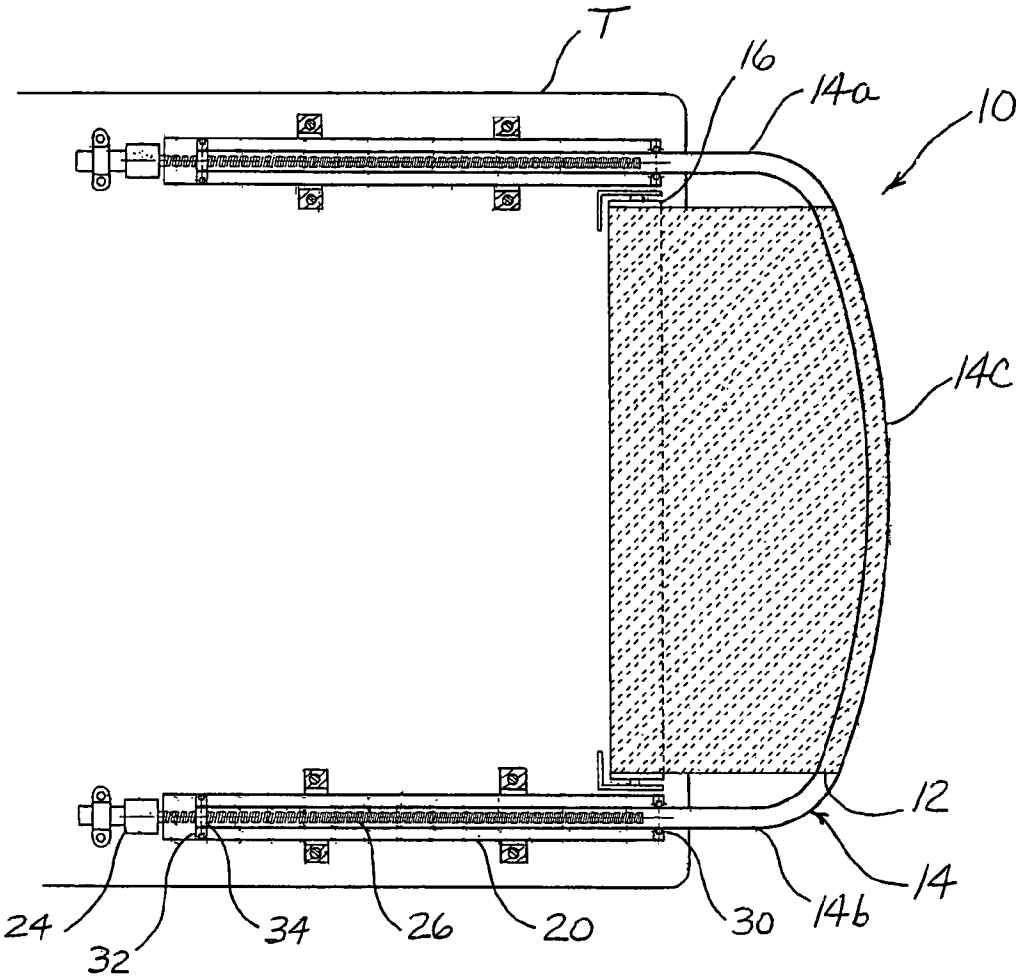
FIG. 7 is an enlarged plan view from below of the retractable bimini top device of FIG. 6 including a partial cross-section taken along the line 7-7 therein.

Referring now to FIGS. 5-7 wherein the present bimini top device 10 is shown in its retracted position, the legs 14*a* and 14*b* of support frame 12 are retracted and drawn together into and substantially through the complete length of each housing tube 20. The support frame legs 14*a* and 14*b* are drawn in unison into such retracted position driven upon the reverse revolutions of lead screws 26 generated by each associated motor 24, the lead screws acting directly through its threaded engagement with the movable inner bearing fitting 32 and its threaded insert 34. While the support frame legs 14*a* and 14*b* are drawn into this retracted position, the movement of the support frame 14 and each of its respective legs is guided and facilitated by the sliding engagement of the support frame legs with the bearing fittings 30 at respective outer ends of the housing tube 20. At the same time the support frame 12 is drawn into the housing tube 20, the extended section of the canvas cover 12 attached to transverse piece 14*c* is drawn onto the spring roller 16 under the influence of its internal spring-loaded force so that upon full retraction of the support frame 14, the transverse piece 14*c* of the support frame is disposed in a position proximate to the edge of the rooftop member T with substantially all of the canvas cover 12 rolled-up onto and stored upon the spring roller 16 just beneath the rooftop member.

Figure 8:
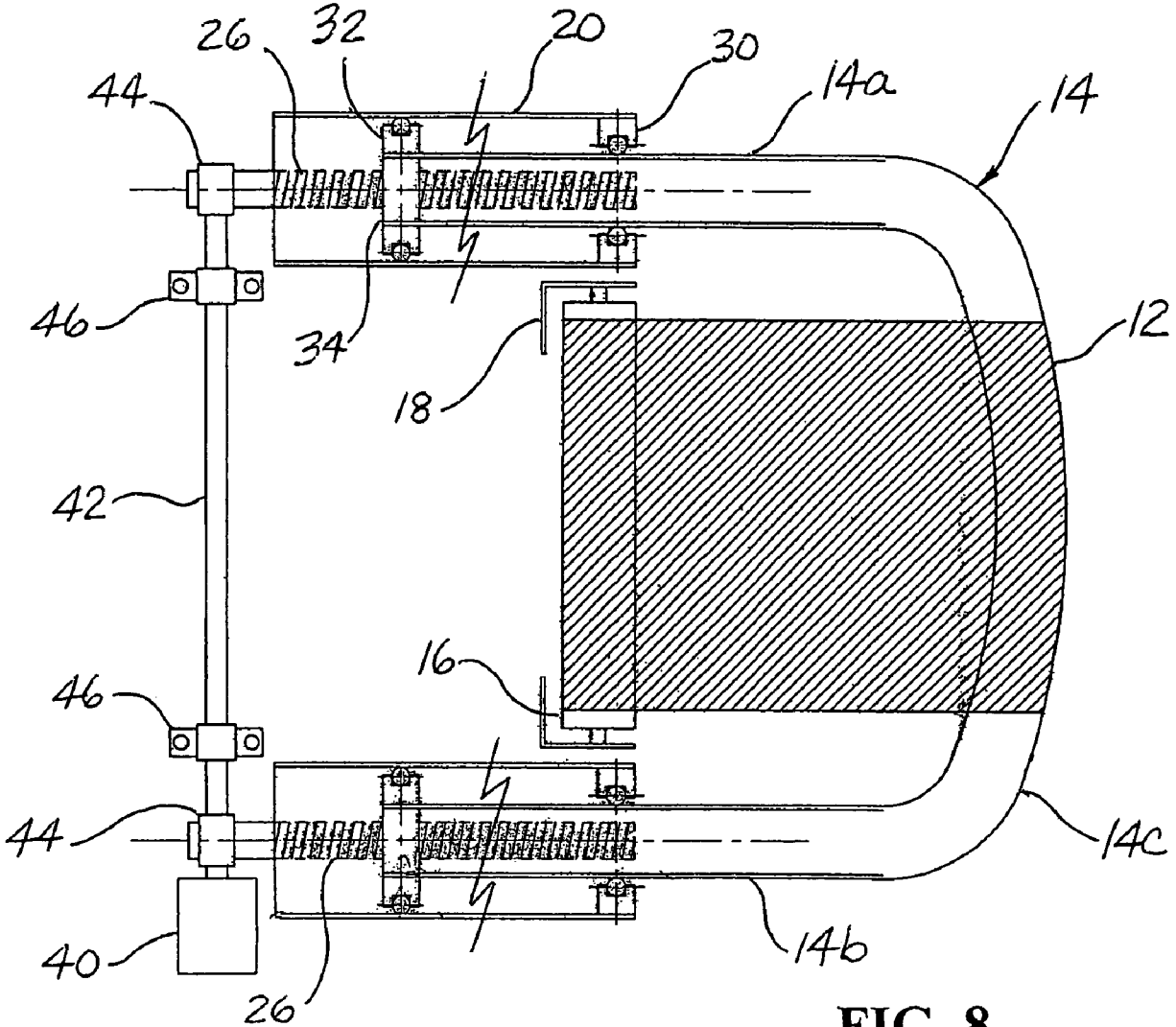
FIG. 8 is a schematic plan view sectioned in part of an alternate embodiment of the retractable bimini top device according to the present invention.

Referring now to FIGS. 8-11, several alternate embodiments of the present retractable bimini top device 10 are illustrated and described here, particularly as to variations in the automated manner used to drive the reversible movement of support frame 14. It is noted with respect to these alternate embodiments that for the most part, the fitted arrangement of the support frame 14 and housing tube 20 together with the attachment and spring-loaded coupling of the canvas cover 12 are substantially the same as described in the preferred embodiment described above. In the embodiment of FIG. 8, one most similar to that described above with respect to FIGS. 1-7, a single reversible motor 40, like that of motors 24, is employed with an associated drive shaft 42 mounted upon the bottom surface of the rooftop member T transversely to the housing tubes 20 using a pair of mounting brackets 46. A pair of worm gears 44 or like rotational converters are coupled to the drive shaft 42 at positions proximate to the ends of the housing tubes 20 and in turn, coupled to a respective lead screw 26 coaxially directed into the housing tube.

Figure 9:
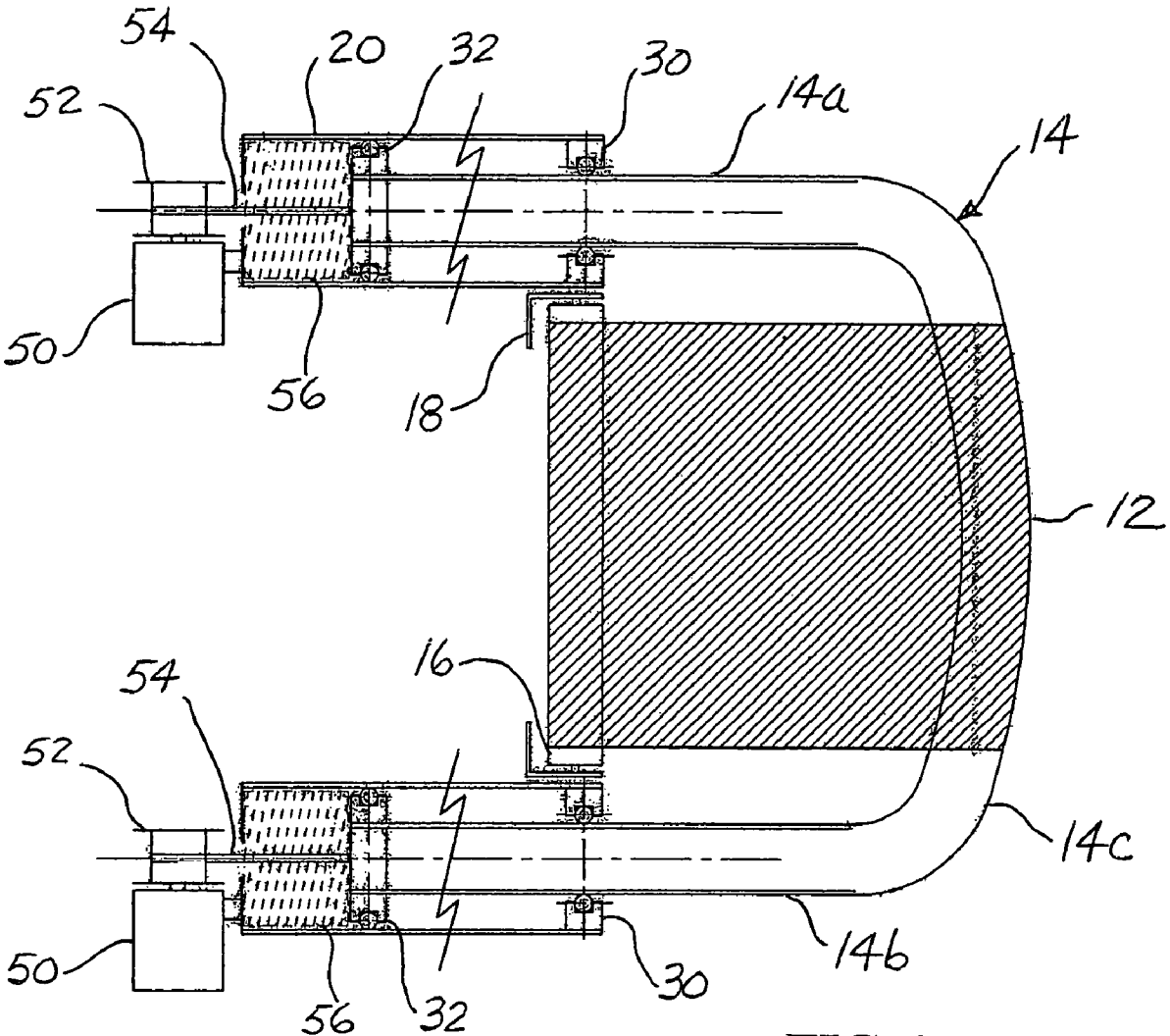
FIG. 9 is a schematic plan view sectioned in part of another alternate embodiment of the present retractable bimini top device.
Figure 10:
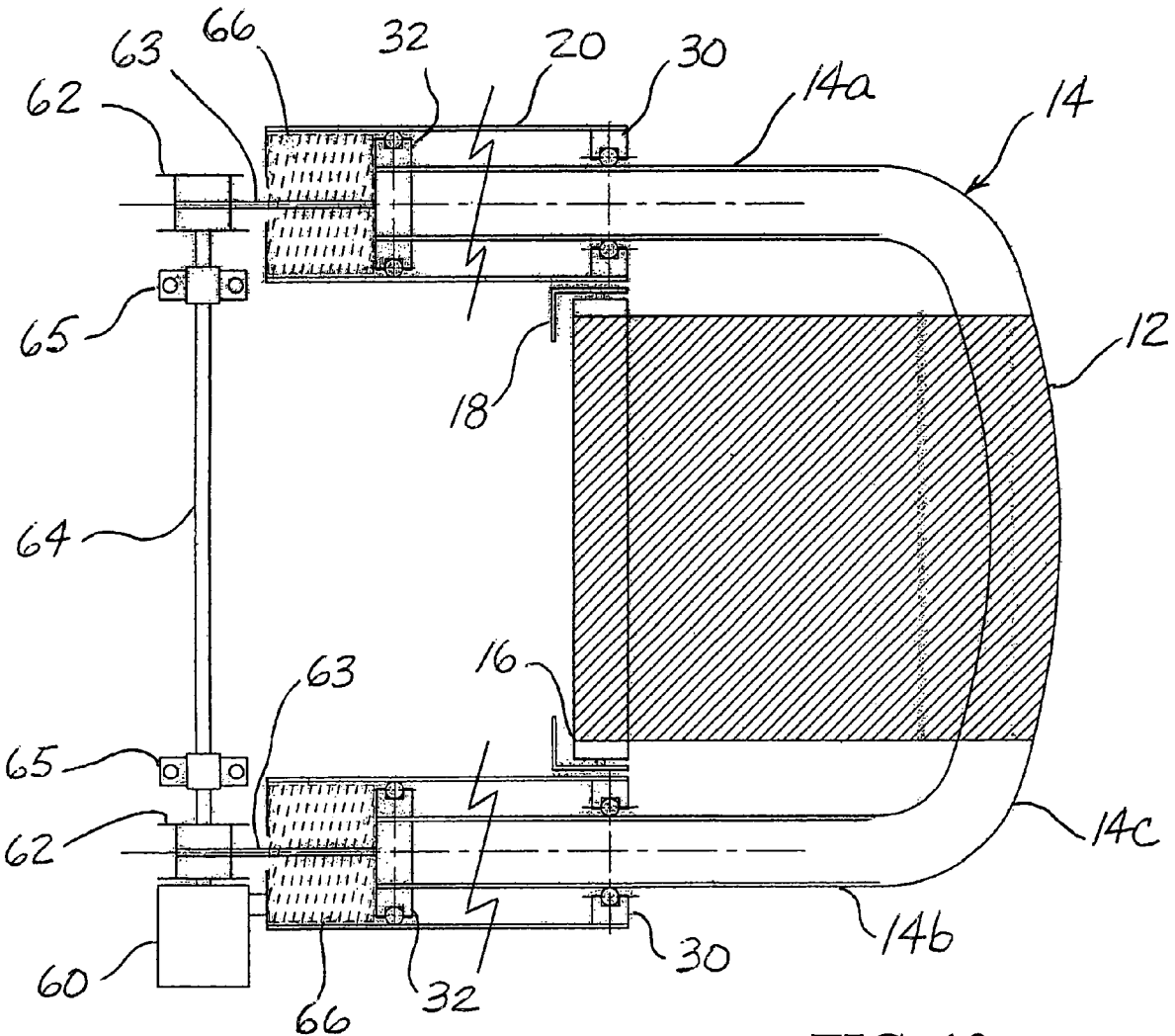
FIG. 10 is a schematic plan view sectioned in part of a further alternate embodiment of the retractable bimini top device according to the present invention.

In both FIGS. 9 and 10, a compression spring 56, typically in a helical coil form, is sized to fit and mounted within each of the respective housing tubes 20 at the inner end thereof opposite to the outer end where the bearing fitting 30 engages the support frame 14. In this mounted position within housing tube 20, each compression spring 56 is made to urge upon inner bearing fittings 32 and the respective support frame legs 14*a* and 14*b* attached thereto thereby providing an outward biasing force upon the support frame 14 in the direction of its extended position. In FIG. 9, opposed drawing forces upon the respective support frame legs 14*a* and 14*b* are equally applied by a pair of unidirectional motors 50 each mounted in proximity to the inner end of a respective housing tube 20 together with an associated pulley member 52 that is coupled to the drive shaft of the motor by means of a conventional clutch. A length of cable 54 is attached at one of its ends to the inner bearing fitting 32 and routed through the compression spring 56 to the pulley member 52 upon which the remaining cable is wound and connected. Under the outward bias forces exerted by the compression spring 56 upon the support frame legs 14*a* and 14, the support frame 14 with the canvas cover 12 attached thereto is pushed forward and outward of the housing tubes 20 to a fully extended position, the clutch coupling of the pulley 52 allowing the length of cable 54 to fully extend. To retract the support frame 14 in this case, the motors 50 are activated and under synchronized control made to pull the length of cable 54 back onto the pulley member 52 and thereby draw the respective support frame legs 14*a* and 14*b* back into the respective housing tubes 20, this while the canvas cover 12 is drawn back onto spring roller 16. In FIG. 10, a similar implementation of an outbound spring force applied to the respective support frame legs 14*a* and 14*b* is accomplished by a pair of compression springs 66 mounted with housing tubes 20 and a drawing force opposed to the spring force is applied using a cable 63 wound upon a pair of motor-driven pulleys 62. In the embodiment of FIG. 10, however, a single unidirectional motor 60 is employed with an extended drive shaft 65 mounted and connected between the separate pulleys.

Figure 11:
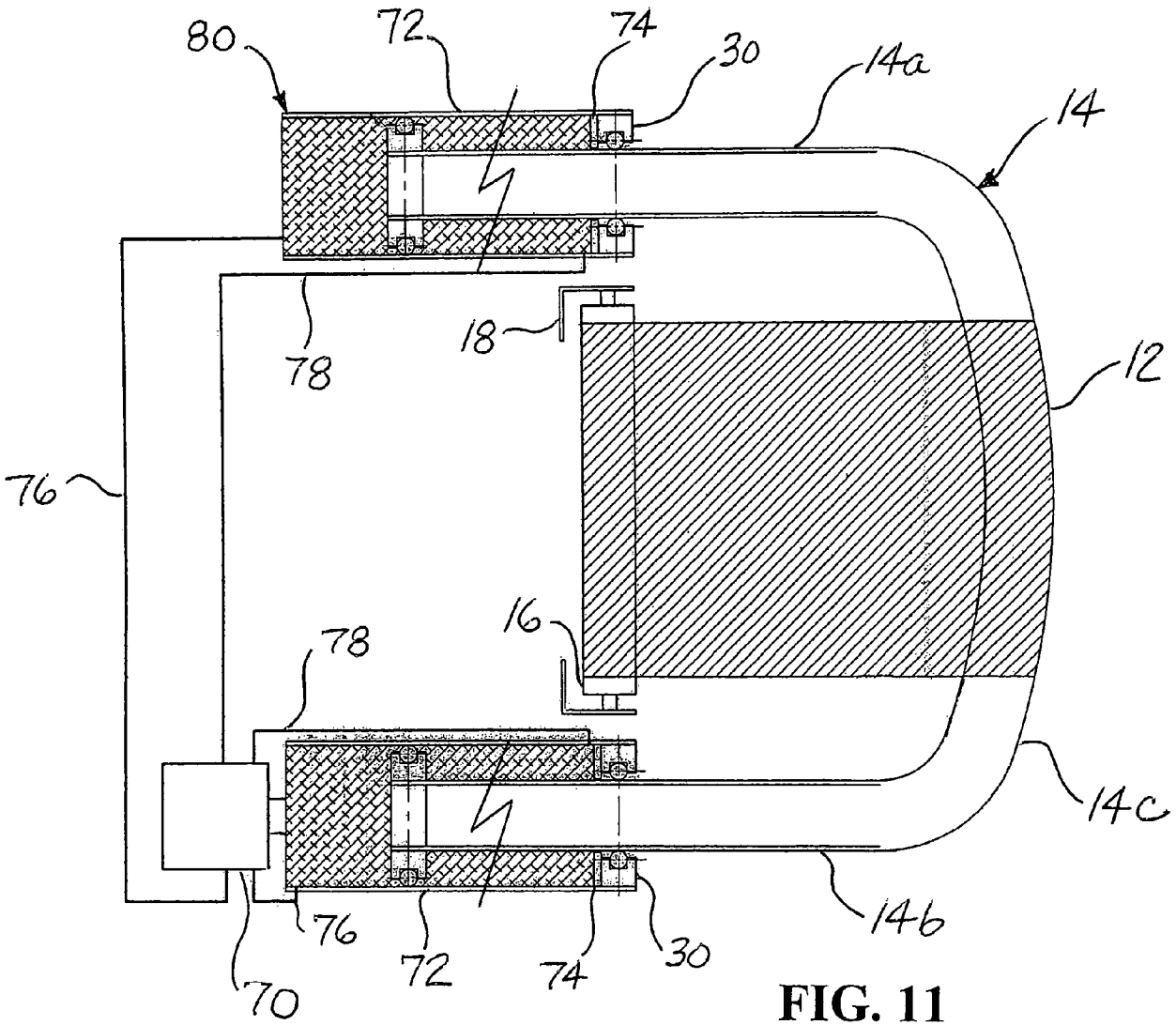
FIG. 11 is a schematic plan view sectioned in part of a still further alternate embodiment of the present retractable bimini top device.

In the embodiment of FIG. 11, a hydraulic version of the automated drive means for reversible movement of the support frame 14 is disclosed. A conventional hydraulic motor pump 70 mounted to the roof-top member T generates fluid under pressure and is controlled to feed the fluid through either a pair of rear fluid lines 76 connected to the back end of the respective housing tubes 80 or a pair of forward fluid lines 78 connected to the front end of the housing tubes. The housing tubes 80 in this case are modified versions of the aforedescribed housing tubes 20 in order to both accept the fluid lines 76 and 78 and to provide adequate sealing of the housing chamber. In this latter regard, the back end of housing tube 80 is closed and additional seals 72 and 74 are provided in connection with bearing fittings 30 and 32. To extend the support frame 14 in this case, controlled fluid pressure is fed from the motor pump 70 to the back ends of the respective housing tubes 80 via fluid lines 76 thereby pushing the respective support frame legs 14*a* and 14*b* forward and outward from the housing tubes. To reverse this movement and retract the support frame 14, rear fluid is released from the back of the chamber of the housing tube 80 and forward fluid fed to the front of the chamber via lines 78.

Figure 12:
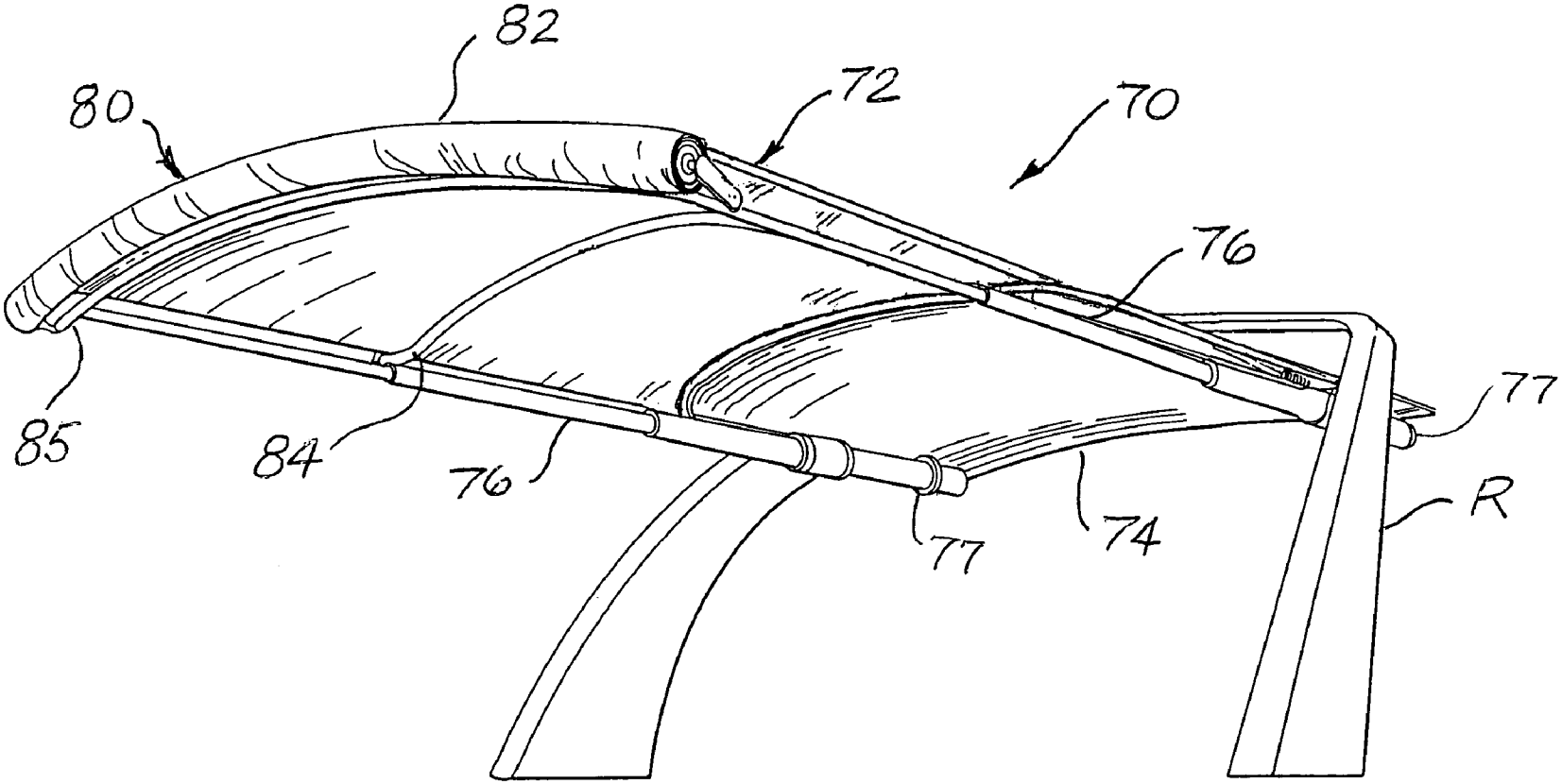
FIG. 12 is a perspective view of a modified version of the retractable bimini top device having an arched canopy configuration and mounted to a conventional radar arch of a boat.

Referring now to FIG. 12, a modified retractable boat top device, generally designated as 70, is shown in an extended deployment upon a conventional radar arch structure R typically erected on recreational boats, the retractable boat top device 70 here providing a distinctive arched configuration in its deployment in accordance with the present invention. The present retractable boat top device 70 comprises an arched canopy assembly 72 that includes a stationery roof section 74 transversely mounted in a substantially horizontal plane within the radar arch R, a pair of telescoping extension arms 76 mounted in parallel alignment on opposite sides of the roof section, and an arched roller assembly 80 adapted to carry an extended length of a flexible canopy material 82 wrapped thereon and driven to move upon the extension arms in reversible directions substantially in the same plane as the stationery roof section. The stationery roof section 74 is formed having an arched surface that is convex in its mounted profile across the width thereof, and has an effective width substantially equal to the transverse opening within the radar arch R. The overall length of the roof section 74 may vary based upon the size and shape of the boat intended for deployment, with the length typically being sufficient to provide equidistant projections fore and aft of the radar arch structure R. A mounting bracket 78, better viewed in FIG. 13, is attached to the interior side walls of the radar arch structure R using conventional fasteners and is used to hold and support the roof section 74 on opposite sides thereof, maintaining the roof section in its stationery position transversely mounted within the radar arch.

Figure 13:
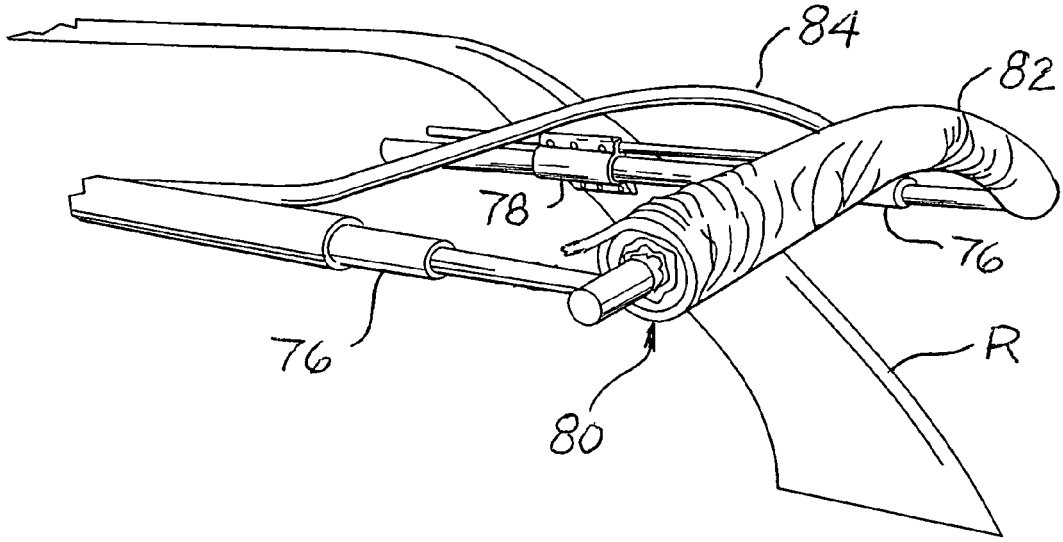
FIG. 13 is a further prospective view of the modified retractable top device of FIG. 12 shown mounted on the radar arch with a section of the canopy removed.

Referring to both FIGS. 12 and 13, the telescoping extension arms 76 are cylindrically-formed longitudinal members comprising a series of tubular segments fitted together and adapted to move coaxially in reversible directions. In similar fashion to the operative combination of housing tubes 20 and legs 14*a*, 14*b* of support frame 14 described above and shown in FIGS. 4-7, the telescoping extension arms 76 of retractable boat top device 70 are mounted in parallel alignment and made to move axially and in unison to deploy flexible canopy material 82, here in the present device conveyed upon arched roller assembly 80. Each of the telescoping extension arms 76 is secured in place upon the radar arch R along opposite sides the roof section 74 using mounting brackets 78. A pair of reversible electronic motor 77, similar to those motors 24 described above with respect to FIGS. 4-7, are mounted separately at each forward most end of the telescoping extension arms 76 and used to drive the movement of the arms and their telescoping segments in alternate linear directions. As in the case of the embodiment shown in FIG. 4, the drive shaft of each reversible motor 77 is adapted and formed as a lead screw having an extended threaded length coaxially disposed through the segments of the telescoping extension arms 76. Similarly to motor units 24, reversible motors 77 are electrically powered and preferably connected to the available power supply on board the boat with the proper operating voltage being provided using conventional inverters and/or regulators as necessary. Synchronized control of the operation of the reversible motors 77 in both directions may also be provided by conventional electrical switching, preferably activated by remote-control means, with limit-switching capabilities to limit the revolutions of the lead screw and the corresponding travel of the telescoping segments of the extension arms 76. The outer ends of the telescoping extension arms 76 rearward on the inner most tubular segments thereof are linked to the arched roller assembly 80 on each side to convey the roller assembly and the flexible canopy material 82 thereon back and forth relative to the stationery roof section 74 in an arched configuration substantially conforming to that of the roof section. An intermediate support frame member 84 formed having a similar arched profile is secured transversely between the extension arms 76 upon corresponding tubular segments intermediately located on each side and routed beneath the flexible canopy material 82 to help maintain the arched configuration of the canopy material 82 during deployment and in the extended state as shown in FIG. 12. A transverse end support member 85 similarly curved in its form may be attached across the outermost ends of the telescoping extension arms 76 and beneath the arched roller assembly 80 to provide support for the roller assembly in its deployed position and help maintain the horizontal level of its movement upon the extension arms.

Figure 14:
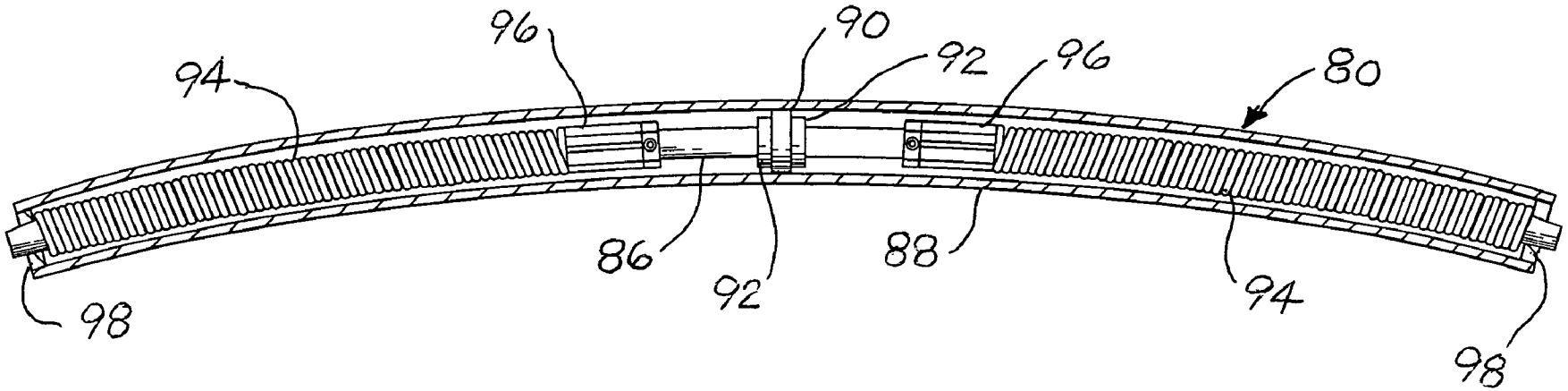
FIG. 14 is a longitudinal cross-section of the arched roller assembly employed in the modified retractable top device of FIG. 12 in accordance with the present invention.

Referring now to FIG. 14 in conjunction with FIGS. 12 and 13, the arched roller assembly 80 for deploying the flexible canopy material 82 in the present retractable boat top device 70 includes a curved roller bar 86 coaxially disposed and supported within the bore of flexible hose member 88 with a pair of elongated torsion springs 94 operatively mounted along the roller bar and secured at the opposite ends of the hose member for rotational deployment of the canopy material in an arched configuration. The curved roller bar 86 is preferably made from a high-strength, corrosion resistant material, such as stainless steel, formed having a common radius of curvature across the length thereof to provide a substantially uniform rounded profile from one end of the bar to the other. The flexible hose member 88 is cylindrical in its fabricated form and made from a strong, durable material, such as rubber or plastic, capable of conforming to the curvature of the roller bar member 86. The curved roller bar 86 is coaxially supported within the conforming hose member 88 by a roller support member 90 and a pair of collar supports 92 positioned together in the middle of the hose member as well as by a pair of end caps 98, one secured in each end of the hose member, to coaxially engage the ends of the roller bar with a bearing support. The roller support member 90 is ring-like in form having an inner diameter sized in excess of the diameter of the curved roller bar 86 to permit its passage therethrough and relative rotational movement therein and an outer diameter sized to fit the bore diameter of the hose member 88 so that the roller support member may be pressed into the bore and secured in place in the middle of the hose member. A set screw (not shown) or the like may be used to engage the outer rim of the roller support member 90 through the wall of hose member 88 to hold the roller support member in place and secure it to the hose member. The collar supports 92, also ring-like in form having an inner diameter sized to fit the roller bar 86 axially therethrough and an outer diameter lesser than that of the bore diameter of hose member 88, are each further adapted to be set upon the roller bar and secured thereto in a position closely bordering opposite sides of the roller support 90 to maintain the central position of the roller support within the hose member.

The elongated torsion springs 94 are assembled over and upon the roller bar 86 within the hose member 88, one torsion spring being disposed on either side of the curved length of the roller bar. Each of the torsion springs 94 is set in position and attached inwardly upon the roller bar 86 by a spring guide 96 cylindrical and slotted in form that is partially inserted upon and connected to the inward end of the torsion spring and secured in place upon the roller bar by a set screw or the like. The outward ends of each torsion spring 94 are adapted to engage upon and secure to the end caps 98 attached at either end of the hose member 88 and thus provide a resistant torque to the rotational movement of the hose member 88 about the curved roller bar 86 during the deployment of the arched roller assembly 80 upon extension arms 76 that serves to maintain needed tension in the roll-out and retraction of the flexible canopy material 82 in its arched configuration.

In the operative implementation of the arched roller assembly 80 of the present retractable boat top device 70, an inward end of the length of canopy material 82 is fastened upon and secured to the surface of the flexible hose member 88 so that the canopy material can be wrapped in continuous layers about the hose member with the opposite or outward end of the canopy material being extended from the roller assembly and coupled to or directly connected upon the rear surface of the stationery roof section 74. In accordance with this implementation of the arched roller assembly 80, the movement of the telescoping extension arms 76 back and forth relative to the stationery roof section 74 produces an associated rotation of the conforming hose member 88 about the curved roller bar 86 and resulting deployment of the canopy material 76 relative to the stationery roof section in an arched configuration that is maintained during roll-out and retraction by resistant torque applied to the rotating hose member in the roller assembly via the torsion springs 94 mounted therein.

Figure 15:
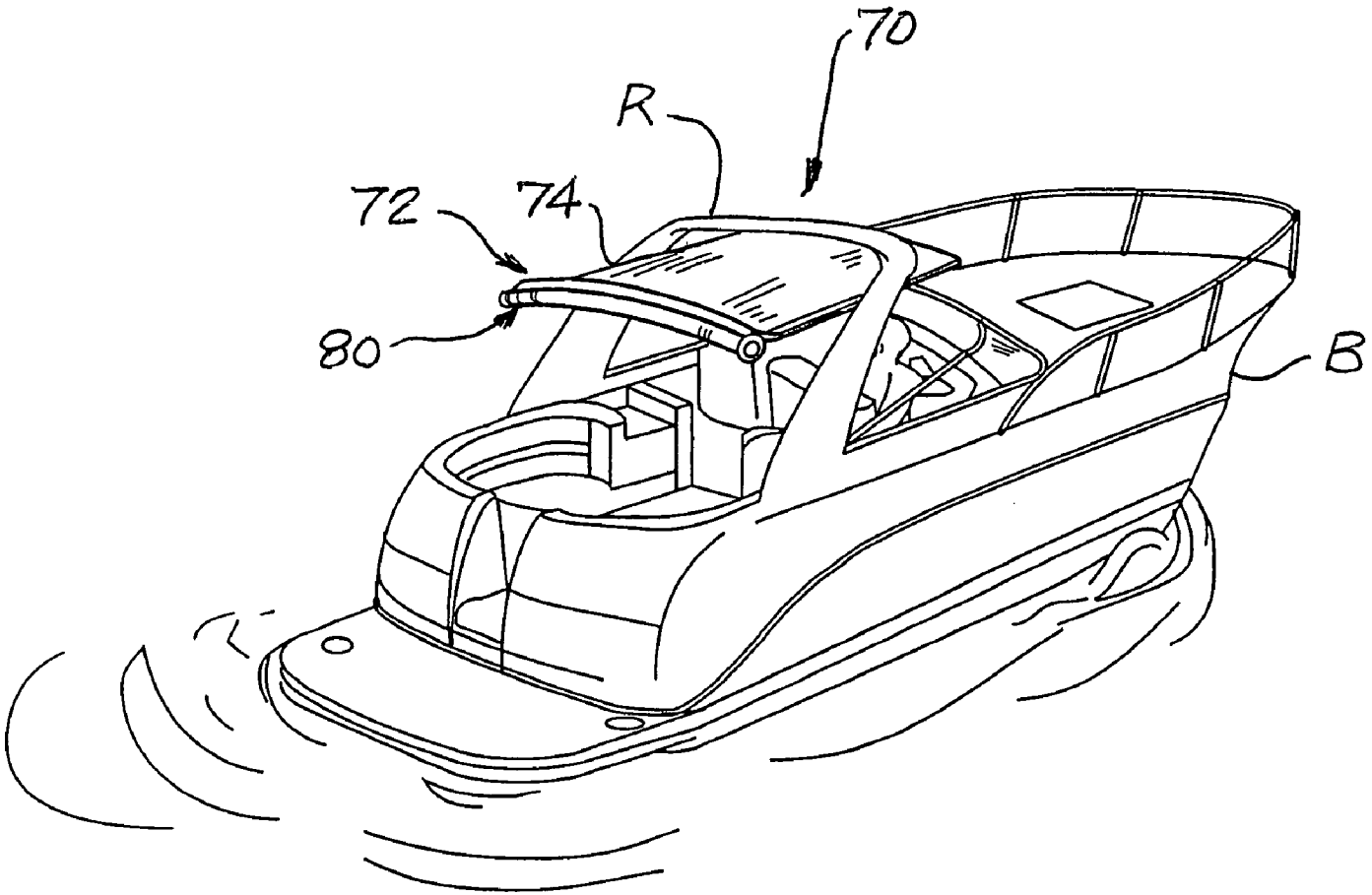
FIG. 15 is a perspective illustration of a recreational boat equipped with the modified retractable canopy top device of FIG. 12 shown in a retracted position.
Figure 16:
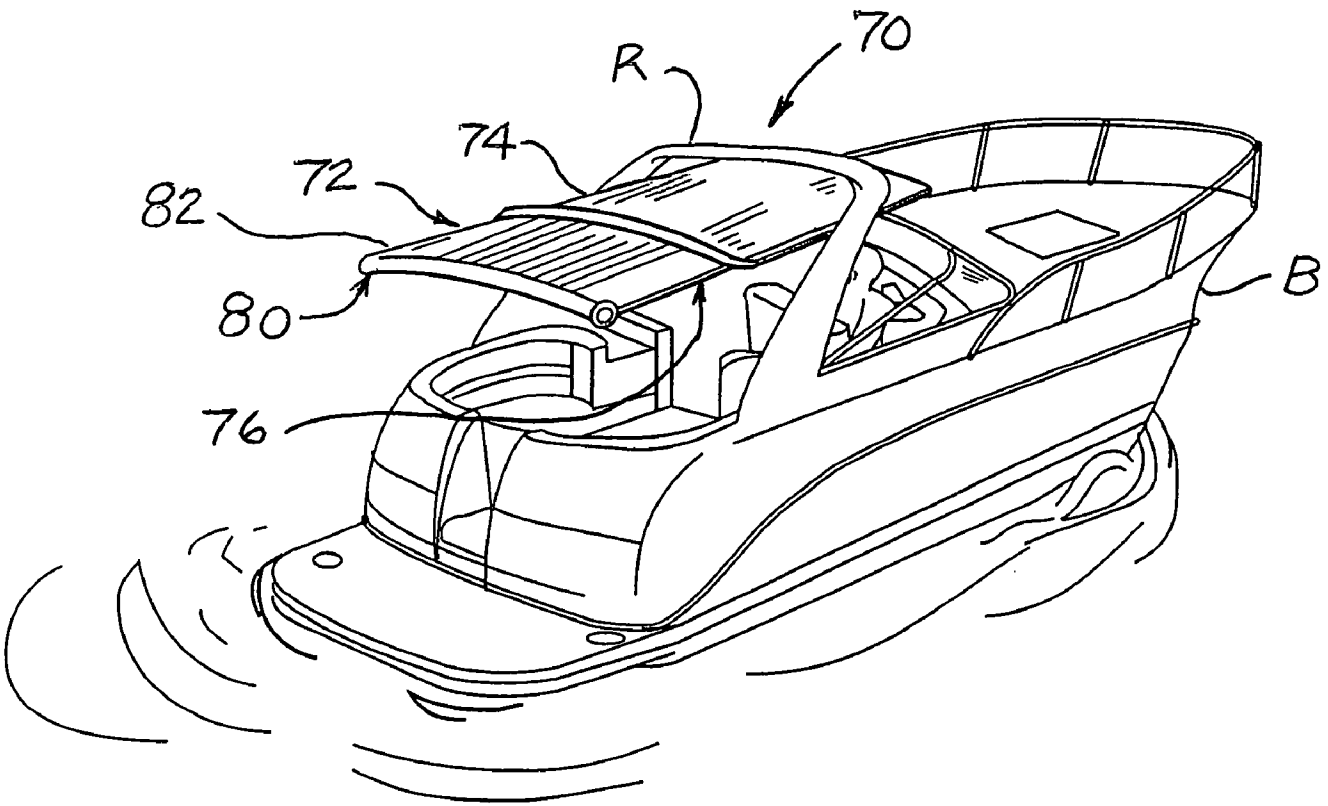
FIG. 16 is a perspective illustration of a recreational boat equipped with the modified retractable canopy top device of FIG. 12 shown in an extended position.

In a normal, retracted state depicted in FIG. 15, the present boat top device 70 is mounted transversely to the radar arch structure R of the recreational boat B with the arched canopy assembly 72 and the arched roller assembly 80 thereof fully retracted against the rearward edge of the stationery roof section 74. When operationally deployed as depicted in FIG. 16, the arched canopy assembly 72 is driven rearward from the stationery roof section 74 in a substantially horizontal plane upon the pair of telescoping extension arms 76 mounted in parallel alignment on opposite sides of the roof section. The arched roller assembly 80 is moved directly upon the extension arms 76 rolling out the flexible canopy material 82 wrapped thereon about the hose member 88 in a continuous extension from the stationery roof section 74 and an arched configuration that is maintained substantially over and across the width of the deck.

Therefore, it is apparent that the described invention provides an improved retractable canopy top for recreational boats that is fully automated and capable of operative attachment to existing overhead structure on the boat without causing obstructions upon the deck. More particularly, the disclosed inventive device provides an improved automated retractable canopy top capable of deployment upon the existing radar arch structure of a recreational boat that effectively shades those on board from the sun and drains any accumulating rain water away from the deck of the boat without adversely affecting headroom of the passengers or visibility of the driver. In its disclosed operative attachment, the present automated retractable canopy top device is capable of providing effective sunshade protection to persons on board a recreational boat without presenting obstacles to their movement or obstructions to their performance of tasks on or around the deck. The disclosed invention is particularly suitable for use upon a sport fishing boat to provide fishermen with needed shade protection even while game fishing and without hindering their performance. In addition, the present inventive device is capable of hands free operation between an extended deployment and retracted state with protection of the retracted top while in storage. Furthermore, the disclosed device is relatively inexpensive to manufacture, easy to assemble and install upon existing boat structure, and capable of improving the functionality and appearance of the boat upon which it is installed.

Obviously, other embodiments and modifications of the present invention will readily come to those of ordinary skill in the art having the benefit of the teachings presented in the foregoing description and drawings. Alternate embodiments of different shapes and sizes, as well as substitution of known materials or those materials which may be developed at a future time to perform the same function as the present described embodiment are therefore considered to be part of the present invention. For example, an adaptation of the described retractable boat top device, particularly including the operative combination of the arched roller assembly 80, flexible canopy material 82 and telescoping extension arms 76, can be assembled to and fitted upon the stationery surface of a building or other structure so that the canopy material may be deployed from the stationery building surface in the same arched configuration that is provided and maintained by the present invention described herein. Accordingly, it is understood that this invention is not limited to the particular embodiment described, but rather is intended to cover modifications within the spirit and scope of the present invention as expressed in the appended claims.

What is claimed is:

1. A retractable canopy device for use in mounted attachment to a radar arch structure on a boat, comprising:

a roof section transversely mounted in a substantially level plane within the radar arch structure, said roof section having an arched surface configuration convex in its mounted profile within the radar arch;

a length of flexible canopy material having one end thereof operatively connected to said roof section; and retractable canopy means mounted upon the radar arch structure and operatively connected to said roof section for automatically deploying a said length of flexible canopy material relative to said roof section in an arched configuration substantially in the same plane as said roof section, said retractable canopy means comprising arched roller means assembled to carry said length of flexible canopy material in a rolled-up state and driven to move in reversible directions to convey said flexible canopy material relative to said roof section in an arched configuration substantially conforming to said roof section, extension arm means operatively mounted to the radar arch structure and connected to said arched roller means to move said arched roller means back and forth relative to said roof section in substantially the same plane, and drive means operatively connected to said extension arm means for driving the movement thereof in reversible directions.

2. A retractable canopy device according to claim 1, wherein said arched roller means comprises:

a flexible hose member adapted to support the canopy material in a rolled-up state and operatively mounted to deploy the canopy material upon rotation;

a roller bar member curved along the length thereof and coaxially supported within said flexible hose member for the rotation thereof; and torsion spring means operatively mounted along said roller bar and secured at opposite ends of said hose member for providing resistant torque in the rotational deployment of the canopy material upon said hose member.

3. A retractable canopy device according to claim 2, wherein said arched roller means further comprises:

roller support means set upon said roller bar member and operatively connected to said hose member for coaxially supporting said roller member within said hose member in a conformed curved configuration.

4. A retractable canopy device according to claim 3, wherein said roller support means comprises:

a roller support member coaxially set in the middle of said hose member, said roller support member being ring-like in form having an inner diameter formed to permit passage of said roller bar member therethrough and an outer diameter secured to the bore diameter of said hose member for rotation therewith;

a pair of collar supports positioned along said roller bar member on opposite sides of said roller support member to maintain the central position of the roller support within said hose member; and a pair of end caps secured at each end of said hose member and coaxially engaging the ends of said roller bar to provide bearing support within said hose member.

5. A retractable canopy device according to claim 1, wherein said extension arm means comprises:

a pair of extension arms mounted in parallel alignment on opposite sides of said roof section, each of said pair of extension arms comprising a series of tubular segments fitted together and adapted to move coaxially in reversible directions.

6. A retractable canopy device according to claim 5, wherein said drive means comprises:

a pair of reversible electronic motors, one of said motors being operatively connected to a respective one of said extension arms.

7. A retractable canopy device according to claim 5, wherein said extension arm means further comprises:

a support frame member formed having an arched profile and secured transversely between said extension arms upon corresponding tubular segments intermediately located along each of said arms, said support frame member being made to route beneath said flexible canopy material and engage therewith to help maintain the arched configuration of said canopy material during deployment and prevent billowing thereof.

8. A retractable canopy device for automated deployment upon elevated structure on the deck of a boat, comprising:

a roof section transversely mounted in a substantially level plane upon the elevated structure, said roof section having an arched surface configuration convex in its mounted profile upon the structure;

a length of flexible canopy material having one end thereof operatively connected to said roof section;

retractable canopy means for automatically deploying said length of flexible canopy material relative to said roof section in an arched configuration substantially in the same plane as said roof section, said retractable canopy means comprising arched roller means assembled to carry said flexible canopy material in a rolled-up state and driven to move in reversible directions to convey said flexible canopy material relative to said roof section in an arched configuration substantially conforming to said roof section, a pair of extension arms mounted in parallel alignment on opposite sides of said roof section, each of said pair of extension arms comprising a series of tubular segments fitted together and adapted to move coaxially in reversible directions, and drive means operatively connected to said pair of extension arms for driving the movement of said extension arms and the tubular segments thereof in reversible directions.

9. A retractable canopy device according to claim 8, wherein said arched roller means comprises:

a flexible hose member adapted to support the canopy material in a rolled-up state and operatively mounted to deploy the canopy material upon rotation;

a roller bar member curved along the length thereof and coaxially supported within said flexible hose member for the rotation thereof; and torsion spring means operatively mounted along said roller bar and secured at opposite ends of said hose member for providing resistant torque in the rotational deployment of the canopy material upon said hose member.

10. A retractable canopy device according to claim 9, wherein said arched roller means further comprises:

roller support means set upon said roller bar member and operatively connected to said hose member for coaxially supporting said roller member within said hose member in a conformed curved configuration.

11. A retractable canopy device according to claim 10, wherein said roller support means comprises:

a roller support member coaxially set in the middle of said hose member, said roller support member being ring-like in form having an inner diameter formed to permit passage of said roller bar member therethrough and an outer diameter secured to the bore diameter of said hose member for rotation therewith;

a pair of collar supports positioned along said roller bar member on opposite sides of said roller support member to maintain the central position of the roller support within said hose member; and a pair of end caps secured at each end of said hose member and coaxially engaging the ends of said roller bar to provide bearing support within said hose member.

12. A retractable canopy device according to claim 8, wherein said drive means comprises:

a pair of reversible electronic motors, one of said motors being operatively connected to a respective one of said extension arms.

13. A retractable canopy device according to claim 8, wherein said retractable canopy means further comprises:

a support frame member formed having an arched profile and secured transversely between said extension arms upon corresponding tubular segments intermediately located along each of said arms, said support frame member being made to route beneath said flexible canopy material and engage therewith to help maintain the arched configuration of said canopy material during deployment and prevent billowing thereof.

14. A retractable canopy top for use in mounted attachment to a stationary surface of a structure, comprising:

a length of flexible canopy material having one end thereof operatively connected to the stationary surface;

arched roller means assembled to carry said length of flexible canopy material in a rolled-up state and driven to move in reversible directions to convey said flexible canopy material relative to the stationary surface in an arched configuration; and extension arm means operatively mounted to the stationary surface and connected to said arched roller means, said extension arm means being driven to move said arched roller means driven back and forth relative to the stationary surface; and drive means operatively connected to said extension arm means for driving the movement thereof in reversible directions.

15. A retractable canopy top according to claim 14, wherein said arched roller means comprises:

a flexible hose member adapted to support the canopy material in a rolled-up state and operatively mounted to deploy the canopy material upon rotation;

a roller bar member curved along the length thereof and coaxially supported within said flexible hose member for the rotation thereof; and torsion spring means operatively mounted along said roller bar and secured at opposite ends of said hose member for providing resistant torque in the rotational deployment of the canopy material upon said hose member.

16. A retractable canopy top according to claim 15, wherein said arched roller means further comprises:

roller support means set upon said roller bar member and operatively connected to said hose member for coaxially supporting said roller member within said hose member in a conformed curved configuration.

17. A retractable canopy top according to claim 16, wherein said roller support means comprises:

a roller support member coaxially set in the middle of said hose member, said roller support member being ring-like in form having an inner diameter formed to permit passage of said roller bar member therethrough and an outer diameter secured to the bore diameter of said hose member for rotation therewith;

a pair of collar supports positioned along said roller bar member on opposite sides of said roller support member to maintain the central position of the roller support within said hose member; and a pair of end caps secured at each end of said hose member and coaxially engaging the ends of said roller bar to provide bearing support within said hose member.

* * * * *